US007446623B2

(12) United States Patent
Tavassoli Hozouri

(10) Patent No.: US 7,446,623 B2
(45) Date of Patent: Nov. 4, 2008

(54) MODE TRANSDUCER STRUCTURE

(75) Inventor: Behzad Tavassoli Hozouri, Santa Clara, CA (US)

(73) Assignee: X-Ether, Inc., Santa Clara, CA (US)

( * ) Notice: Subject to any disclaimer, the term of this patent is extended or adjusted under 35 U.S.C. 154(b) by 142 days.

(21) Appl. No.: 11/160,904

(22) Filed: Jul. 14, 2005

(65) Prior Publication Data

US 2007/0013457 A1 Jan. 18, 2007

(51) Int. Cl.
*H01P 1/16* (2006.01)
*H01P 1/06* (2006.01)

(52) U.S. Cl. ..... 333/21 R; 333/257

(58) Field of Classification Search ..... 333/21 R, 333/248, 256, 257, 21 A, 137
See application file for complete search history.

(56) References Cited

U.S. PATENT DOCUMENTS

| | | | | |
|---|---|---|---|---|
| 2,708,263 | A | | 5/1955 | Walters |
| 2,941,166 | A | * | 6/1960 | Meyer ..... 333/125 |
| 2,941,168 | A | | 6/1960 | Caswell |
| 3,715,688 | A | | 2/1973 | Woodward |
| 4,654,613 | A | | 3/1987 | Fischer |
| 5,442,329 | A | | 8/1995 | Ghosh et al. |

FOREIGN PATENT DOCUMENTS

| | | | |
|---|---|---|---|
| GB | 597240 | A | 2/1948 |
| GB | 2218854 | A | 11/1989 |
| WO | 2005/041344 | A1 | 6/2005 |

OTHER PUBLICATIONS

Ragan, G.L., Microwave Transmission Circuits, MIT Radiation Laboratory Series, vol. 9, McGraw-Hill, New York, 1948, pp. 379-405.

PCT Written Opinion of the International Searching Authority for PCT/US06/26601, Sep. 4, 2007.

* cited by examiner

*Primary Examiner*—Benny Lee
(74) *Attorney, Agent, or Firm*—Patent Venture Group; Raymond E. Roberts

(57) ABSTRACT

A mode transducer for converting an electromagnetic wave between $TE_{1,0}$ and $TM_{0,1}$ modes. A rectangular waveguide guides the wave while in $TE_{1,0}$ mode and a circular waveguide guides the wave while in $TM_{0,1}$ mode. The rectangular waveguide and the circular waveguide are joined by a chamber to form a right angle structure. The chamber particularly includes offset walls distended away from proximal portions of the rectangular waveguide to convert the electromagnetic wave between modes. Two of the mode transducers rotatably coupled with a suitable rotation mechanism may be used as a rotary waveguide joint.

16 Claims, 7 Drawing Sheets

FIG. 1a (background art)
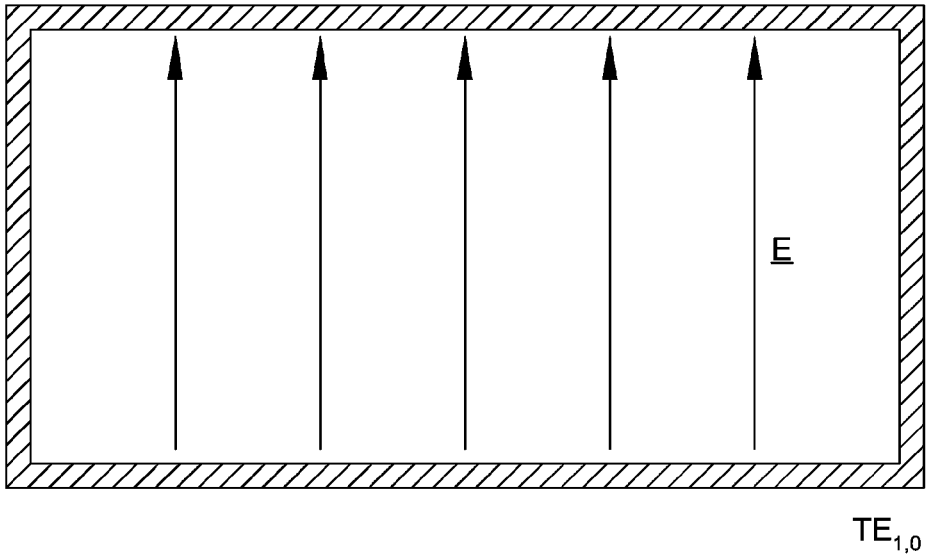
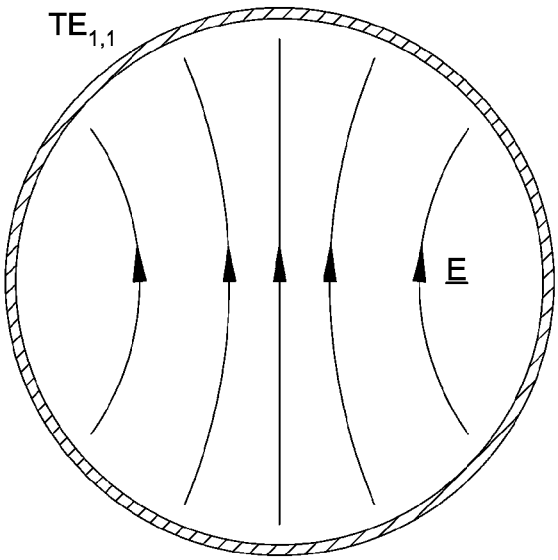
FIG. 1b (background art)
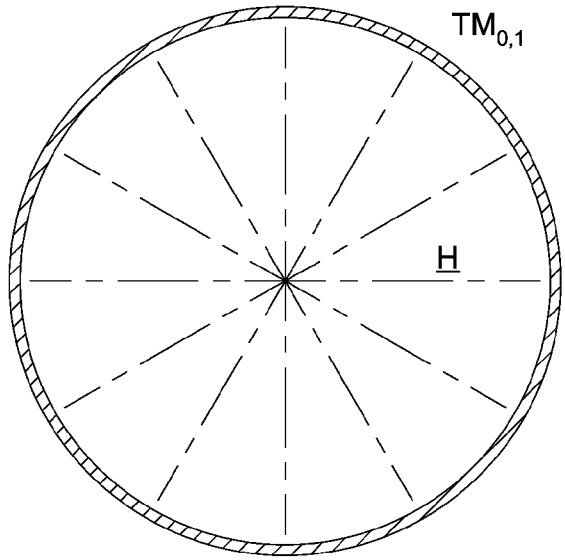
FIG. 1c (background art)

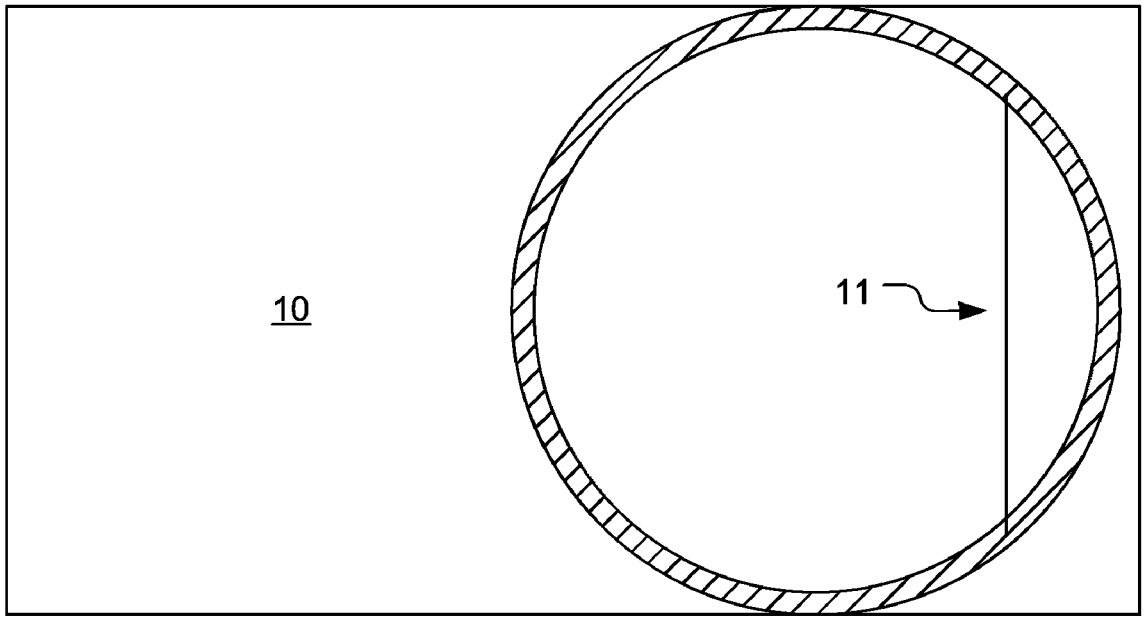
FIG. 3a (background art)
FIG. 3b (background art)
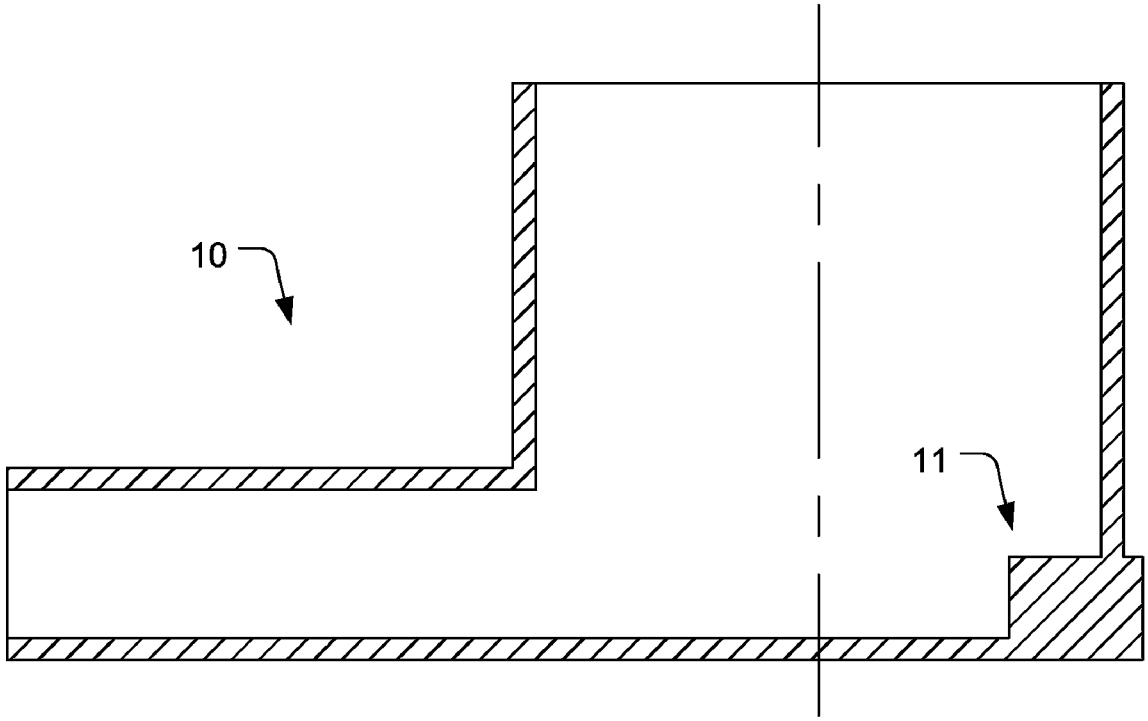

FIG. 4a
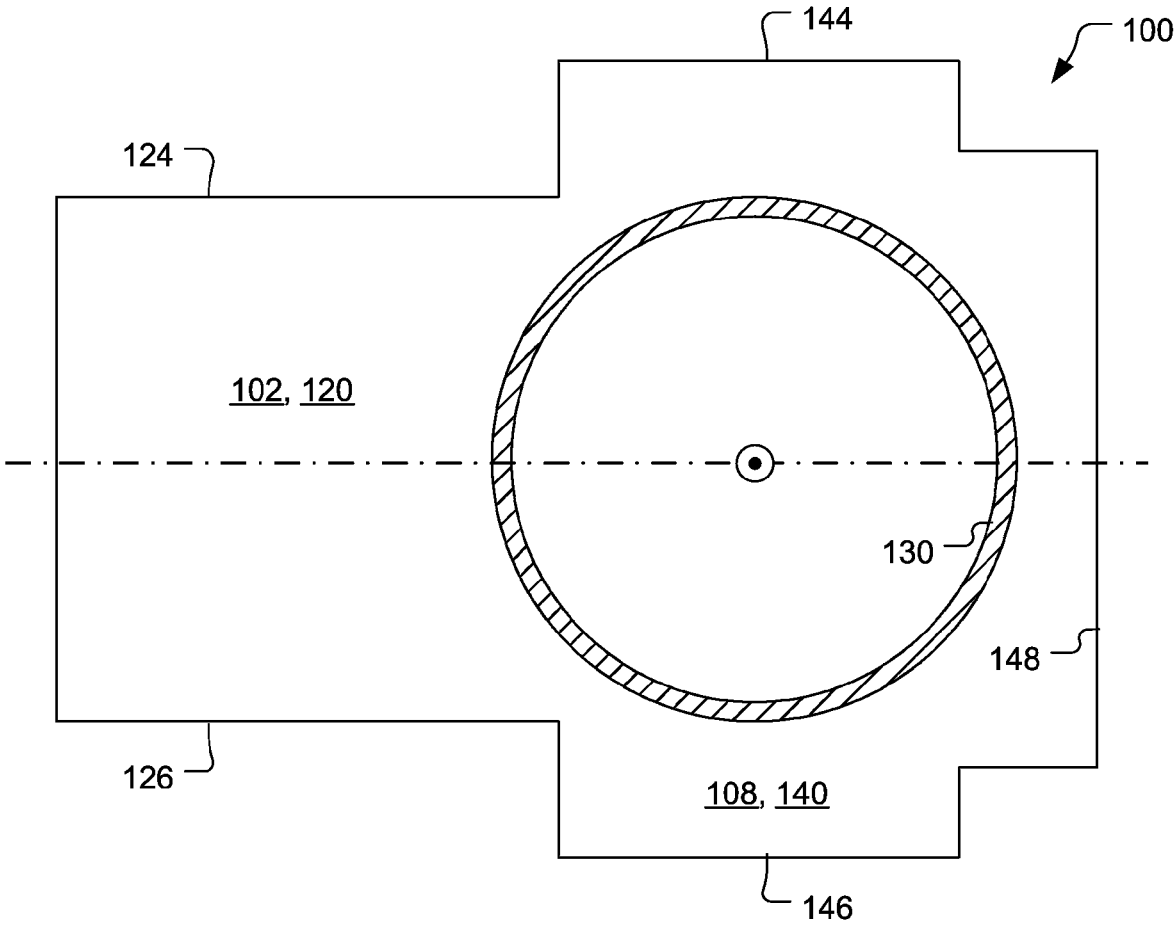
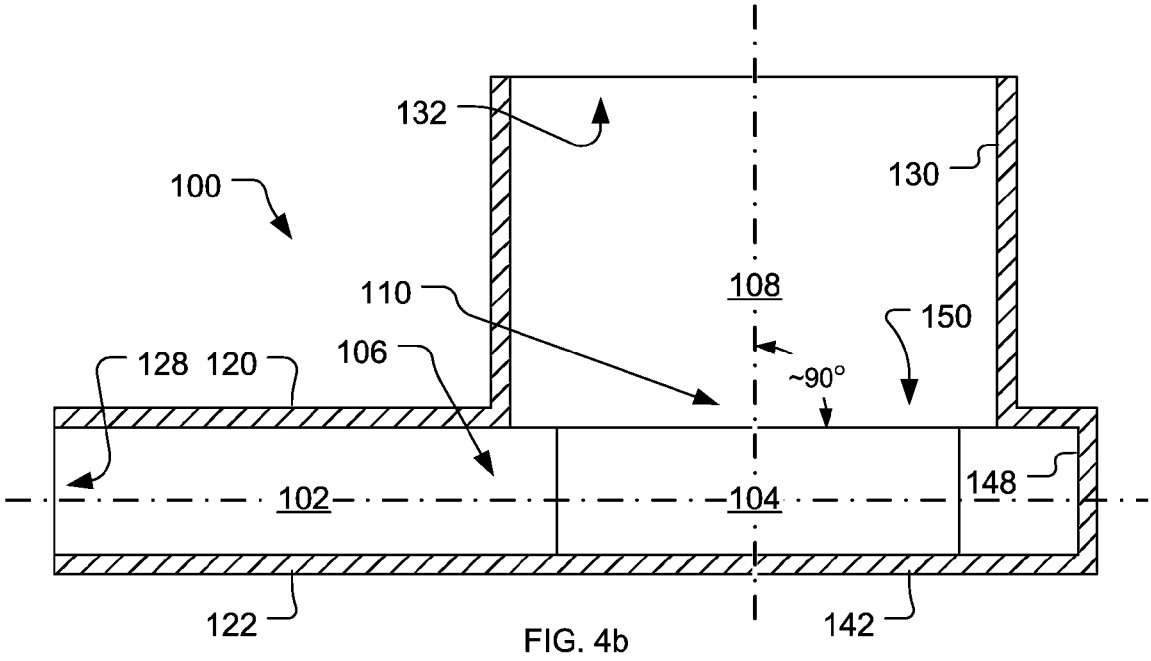
FIG. 4b

MODE TRANSDUCER STRUCTURE

CROSS-REFERENCES TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Technical Field

The present invention relates generally to electric wave transmission systems wherein electromagnetic wave energy is guided or constrained, and more particularly to mode converters for changing guided waves having one field configuration to a different field configuration, wherein the original and the changed waves each have a longitudinal electric or magnetic field component.

2. Background Art

Many radio frequency applications today require electromagnetic energy at high power levels and at frequencies in the 1 to 150 GHz range. Some common examples are radio frequency heating, radar, satellite communications, and high energy physics.

Waveguides are used to propagate electromagnetic energy within much of the equipment used by such applications. A waveguide is usually categorized by its shape and its mode of operation. Waveguide shape is simply the predominant cross-sectional shape, and is most often simply spoken of as being "rectangular" or "circular." This coincidentally defines a "waveguide axis" that is perpendicular to and centered through the waveguide cross-section.

Waveguide modes are categorized according to the nature of the longitudinal components of the electric ($E_Z$) and magnetic ($H_Z$) fields of the electromagnetic energy that they are used with, i.e., with respect to field vectors perpendicular to the waveguide axis. Such modes are generally referred to as being either "transverse-electric" (TE), meaning that the electric field vector is perpendicular to the waveguide axis or "transverse-magnetic" (TM), meaning that the magnetic field vector is perpendicular to the waveguide axis. The modes are further categorized by subscripts mathematically derived from $E_Z$ and $H_Z$. Numerous texts describe the derivation of such subscripts, but that process is not relevant here.

FIGS. 1*a*-1*c* (background art) depict some conventional waveguide examples and particular aspects of them that serve to illustrate various important points. FIG. 1*a* shows a rectangular waveguide operating in $TE_{1,0}$ mode. In a rectangular waveguide, $TE_{1,0}$ mode is dominant. FIG. 1*b* shows a circular waveguide operating in $TE_{1,1}$ mode. In a circular waveguide, $TE_{1,1}$ mode is dominant. Other modes are possible and useful, however, and FIG. 1*c* depicts one of particular interest. FIG. 1*c* shows a circular waveguide in $TM_{0,1}$ mode.

In FIGS. 1*a*, 1*b* solid arrowed lines depict the electric field (E) and in FIG. 1*c* dashed arrowed lines depict the magnetic field (H). By comparison of FIG. 1*b* and FIG. 1*c* it can now be seen why $TM_{0,1}$ mode is also termed a "circularly symmetric" mode.

Designing waveguides that efficiently propagate electromagnetic energy in one direction and in one mode of operation is generally a mature art. Unfortunately, many important applications today require more, changing from one waveguide shape to another, changing from one waveguide mode of operation to another, or changing the direction of energy propagation. In some critical applications, such as scanning radars and satellite communications, all of these are needed.

When changing the direction of propagation a small amount of rotation can usually be accommodated by using flexible coaxial cables or waveguides. This approach has been used in radars for more than 50 years. This does not, however, provide for continuous 360-degree rotation.

When substantial or full rotational capability in an electromagnetic wave transmission path is desirable or necessary, the rotary joint is the preferred apparatus. In general, a rotary joint desirably operates over the full rotation range with minimum insertion loss and voltage standing wave ratio (VSWR), minimum distortion of the electromagnetic wave, and with minimum variation over the frequency band as rotation takes place.

FIG. 2 (prior art) is a cross-sectional view of a rotary waveguide joint 1 in accord with the teachings of U.S. Pat. No. 2,708,263 by Walters. This example has two major sections 2 that are rotatably joined by a rotation mechanism 3. Each major section 2 includes a rectangular waveguide sub-section 4 and a circular waveguide sub-section 5. The rectangular waveguide sub-sections 4 each have a waveguide axis 6 and the circular waveguide sub-section 5 share a common waveguide axis 7. To facilitate understanding the rotary waveguide joint 1 is shown with the axes 6, 7 all co-planar. Of course, this is not always the case in actual operation.

In use, the rotary waveguide joint 1 accepts electromagnetic energy in $TE_{1,0}$ mode through one rectangular waveguide sub-section 4, converts it to the circularly symmetric $TM_{0,1}$ mode and propagates it through the corresponding circular waveguide sub-section 5. The rotation mechanism 3 includes a break between the circular waveguide sub-sections 5 that acts as a small-gap radio frequency choke to provide an effective short-circuit at the frequency of the electromagnetic energy. This permits the electromagnetic energy to be propagated into and through the other circular waveguide sub-section 5, and then converted back to $TE_{1,0}$ mode and propagated through the remaining rectangular waveguide sub-section 4.

Efficient propagation particularly needs to occur regardless of the rotational orientations of the two major sections 2, and that is why the electromagnetic energy is preferably in circularly symmetric $TM_{0,1}$ mode as it passes through the two circular waveguide sub-sections 5. In this mode the orientation of the electric (E) and magnetic (H) field patterns is independent of the rotational relationship of the two major sections 2 of the rotary waveguide joint 1.

With reference again briefly to FIG. 1*c*, it can be seen that $TM_{0,1}$ mode is characterized by a radially extending electric field with constant amplitude and phase as a function of angular rotation about the periphery. This characteristic particularly makes this mode suitable for use with rotary joints. This also makes this mode suitable for use in applications where structural rotation is not necessarily employed, such as in particle accelerators in modern physics laboratories.

One means of exciting the $TM_{0,1}$ mode is with a step transition at an interface where a rectangular waveguide forms a right angle junction to a circular waveguide. This suppresses the otherwise dominant $TE_{1,1}$ mode. In the example in FIG. 2, each of the major sections 2 has such a step transitions 8 where the rectangular waveguide sub-sections 4 transition into their respective circular waveguide sub-sections 5.

FIGS. 3*a*, 3*b* (background art) depicts a simplified waveguide structure 10 having a step transition 11. FIG. 3*a* shows the waveguide structure 10 in top plan view and FIG. 3*b* shows the waveguide structure 10 in side cross-section view. An important point to be noted here is that the waveguide structure 10 is a very difficult one to manufacture. The same is true of the elements of the rotary waveguide joint 1 in FIG. 2.

As is well known in the art, when using devices for transferring high power electromagnetic waves it is necessary that sharp edges be blended (rounded or smoothed), and to generally have as few structural changes and connections as possible. This prevents arcing and contributes to more efficient energy propagation. Accomplishing this is difficult and expensive in device manufacture, however, when edges are not complete circles or even straight edges, and particularly when an edge is not accessible for finishing. It follows that the example waveguide structures 1, 10 shown, especially at the step transitions 8, 11, require design compromises or the use of very extra-ordinary machining techniques.

It follows that what is need is an improved mode transducer structure.

BRIEF SUMMARY OF THE INVENTION

Accordingly, it is an object of the present invention to provide an improved mode transducer structure.

Briefly, one preferred embodiment of the present invention is an apparatus for converting the mode of a guided electromagnetic wave from a first field configuration to a second field configuration. A rectangular waveguide section, having a rectangular-section axis, a chamber section, and a circular waveguide section, having a circular-section axis, are all provided. The rectangular waveguide section joins the chamber section at a rectangular-juncture and the circular waveguide section joins the chamber section at a circular-juncture such that the two section axes form a right angle. The rectangular waveguide section has a first and second broadwalls, and first and second sidewalls that collectively define a rectangular-end opposed to the rectangular-juncture. The circular waveguide section has a circular wall that defines a circular-end opposed to circular-juncture. The chamber section has an aperture-wall joining the first broadwall, a base-wall joining the second broadwall, and a first and second offset walls, joining the first and second sidewalls, all at rectangular-juncture. The chamber section further has a third offset wall opposed to the rectangular-juncture. The aperture-wall includes an aperture corresponding with the circular-juncture. The first and second offset walls are disposed more distantly away from the rectangular-section axis than the first and second sidewalls are, and the first, second, and third offset walls are disposed more distantly away from the circular-section axis than the circular wall is. Optionally, two of the just described apparatuses, as first and second mode transducers, can be rotatably joined at the circular-ends with a rotation mechanism to efficiently pass the electromagnetic wave in the second field configuration between the two mode transducers regardless of the relationships between the respective rectangular-section axes.

An advantage of the present invention is that it is simpler to manufacture, even as a unitary construction, if desired, and thus leading to cost savings and increased reliability.

And another advantage of the invention is that it can efficiently handle electromagnetic wave mode conversion even at high power levels.

These and other objects and advantages of the present invention will become clear to those skilled in the art in view of the description of the best presently known mode of carrying out the invention and the industrial applicability of the preferred embodiment as described herein and as illustrated in the figures of the drawings.

BRIEF DESCRIPTION OF THE SEVERAL VIEWS OF THE DRAWING(S)

The purposes and advantages of the present invention will be apparent from the following detailed description in conjunction with the appended figures of drawings in which:

FIGS. 1*a*-1*c* (background art) depict conventional waveguide examples and their particular aspects of interest, wherein FIG. 1*a* shows a rectangular waveguide operating in $TE_{1,0}$ mode, FIG. 1*b* shows a circular waveguide operating in $TE_{1,1}$ mode, and FIG. 1*c* shows a circular waveguide in $TM_{0,1}$ mode.

FIG. 2 (prior art) is a cross-sectional view of a conventional rotary waveguide joint.

FIGS. 3*a*, 1*b* (background art) depict a simplified waveguide structure having a step transition, wherein FIG. 3*a* shows it in top plan view and FIG. 3*b* shows it in side cross-section view.

FIGS. 4*a*, 1*b* depict an embodiment of a mode transducer in accord with the present invention, wherein FIG. 4*a* shows it in top plan view and FIG. 4*b* shows it in side cross-section view.

In the various figures of the drawings, like references are used to denote like or similar elements or steps.

BEST MODE FOR CARRYING OUT THE INVENTION

Figure 2:
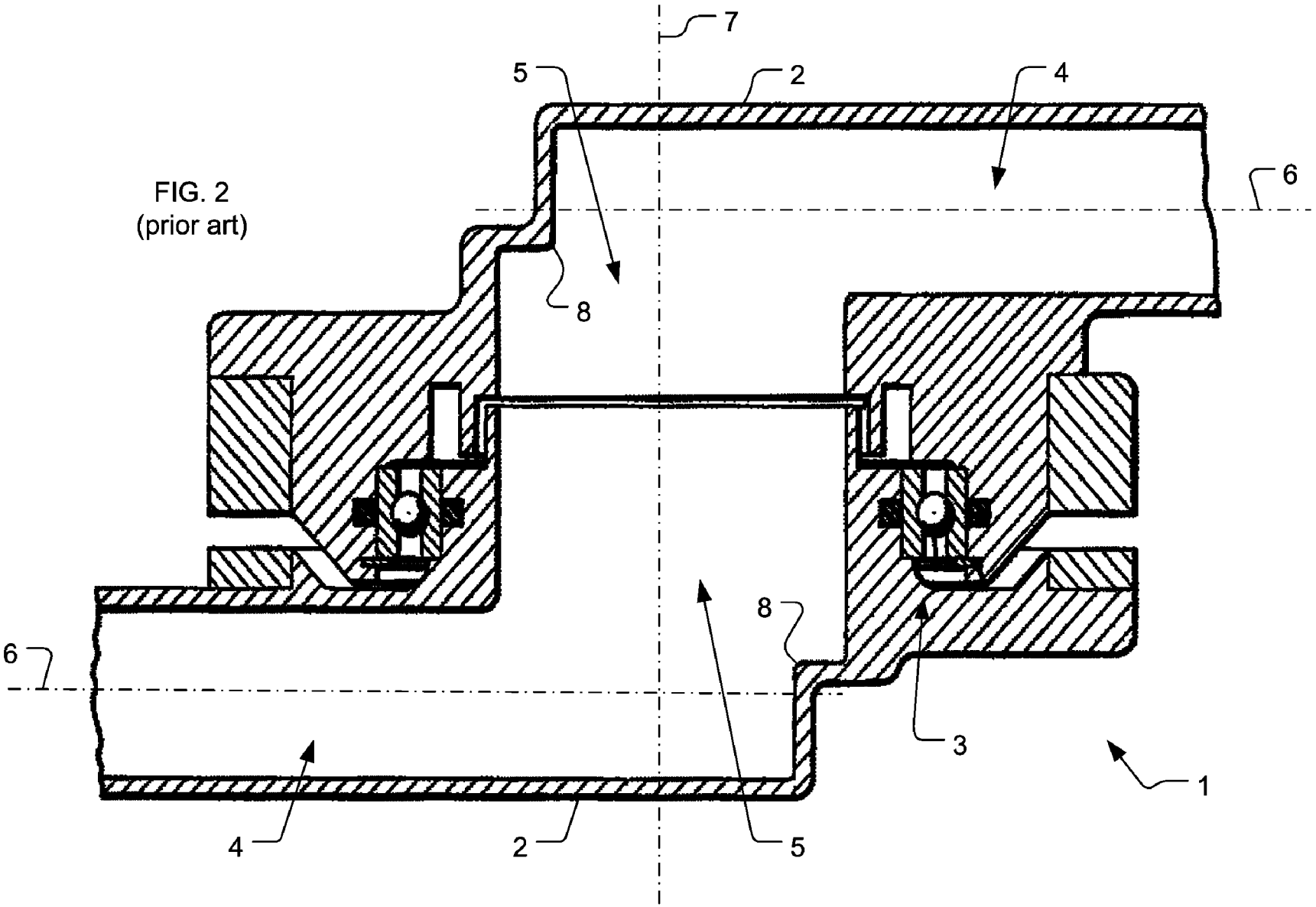
FIG. 2 (prior art)

A preferred embodiment of the present invention is a mode transducer structure. As illustrated in the various drawings herein, and particularly in the views of FIGS. 4*a*, 4*b* through FIG. 9, preferred embodiments of the invention are depicted by the general reference characters 100 and 200.

FIGS. 4*a*, 4*b* depict one embodiment of a mode transducer 100 that is in accord with the present invention. FIG. 4*a* shows the mode transducer 100 in top plan view and FIG. 4*b* shows it in side cross-section view. The overall appearance of the mode transducer 100 is "cross-shaped."

The mode transducer 100 includes a rectangular waveguide section 102 (FIGS. 4*a*, 4*b*) that joins a chamber section 104 (FIG. 4*b*) at a rectangular-juncture 106 (FIG. 4*b*), which, in turn, joins a circular waveguide section 108 (FIGS. 4*a*, 4*b*) at a circular-juncture 110 (FIG. 4*b*). As shown, a central axis through the rectangular waveguide section 102 (FIGS. 4*a*, 4*b*) and a central axis through the circular waveguide section 108 (FIGS. 4*a*, 4*b*) nominally form a right angle designated by the symbol ~90 °.

The rectangular waveguide section 102 (FIGS. 4*a*, 4*b*) a first broadwall 120 (FIGS. 4*a*, 4*b*) and a second broadwall 122 (FIG. 4*b*), and first and second sidewalls 124, 126 (FIG. 4*a*). These collectively define a rectangular-end 128 (FIG. 4*b*) that is located opposite the rectangular-juncture 106 (FIG. 4*b*). The circular waveguide section 108 (FIGS. 4*a*, 4*b*) has a circular wall 130 (FIGS. 4*a*, 4*b*) that defines a circular-end 132 (FIG. 4*b*) that is located opposite the circular-juncture 110 (FIG. 4*b*).

The chamber section 104 (FIG. 4*b*) has an aperture-wall 140 (FIG. 4*a*), a base-wall 142 (FIG. 4*b*), and first and second offset walls 144, 146 (FIG. 4*a*) joining with elements of the rectangular waveguide section 102 (FIGS. 4*a*, 4*b*) at the rectangular-juncture 106 (FIG. 4*b*) as shown. The chamber section 104 (FIG. 4*b*) further has a third offset wall 148 (FIGS. 4*a*, 4*b*) located opposite the rectangular-juncture 106 (FIG. 4*b*). The aperture-wall 140 (FIG. 4*a*) includes an aperture 150 (FIG. 4*b*) corresponding with the circular-juncture 110 (FIG. 4*b*). The first and second offset walls 144, 146 (FIG. 4*a*) are extended outward from the rectangular section's central axis, and the third offset wall 148 (FIGS. 4*a*, 4*b*) is similarly extended outward from the circular section's central axis.

It should be noted that the extended offset walls 144, 146 (FIGS. 4*a*, 4*b*) and the extended offset wall 148 (FIG. 4*b*) are one particular point of novelty in the mode transducer 100. The offset walls 144, 146 (FIGS. 4*a*, 4*b*) and the extended offset wall 148 (FIG. 4*b*) partly move outward the narrower walls (the sidewalls 124, 126 (FIG. 4*b*)) of rectangular waveguide section 102 (FIGS. 4*a*, 4*b*) of rectangular waveguide section 102 (FIGS. 4*a*, 4*b*) close to where the different waveguides meet in the chamber section 104 (FIG. 4*b*). This avoids any intersection between the main edges of the rectangular and circular waveguide sections 102, 108 (FIGS. 4*a*, 4*b*). Another point to particularly note is the absence of a step transition (see e.g., step transitions 8, 11 in FIGS. 2 and 3*a*, 3*b*), with all of the attendant manufacturing difficulty that such a feature and integrating it into the overall structure would require. The presence of the offset walls 144, 146 (FIGS. 4*a*, 4*b*) and the extended offset wall 148 (FIG. 4*b*) obviates the need for a step transition, by instead serving to suppress excitation in the $TE_{1,1}$ mode in favor of excitation in the desired $TM_{0,1}$ mode. They also permit keeping the circular-juncture 110 (FIG. 4*b*) fully circular, that is, not compromising on this as some prior art does. As was noted in the Background section, above, step transitions are an important feature in prior of art structures. They are notoriously difficult to manufacture without resorting to compromises that undermine efficiency or that even increase the risk of end product failure.

Figure 5:
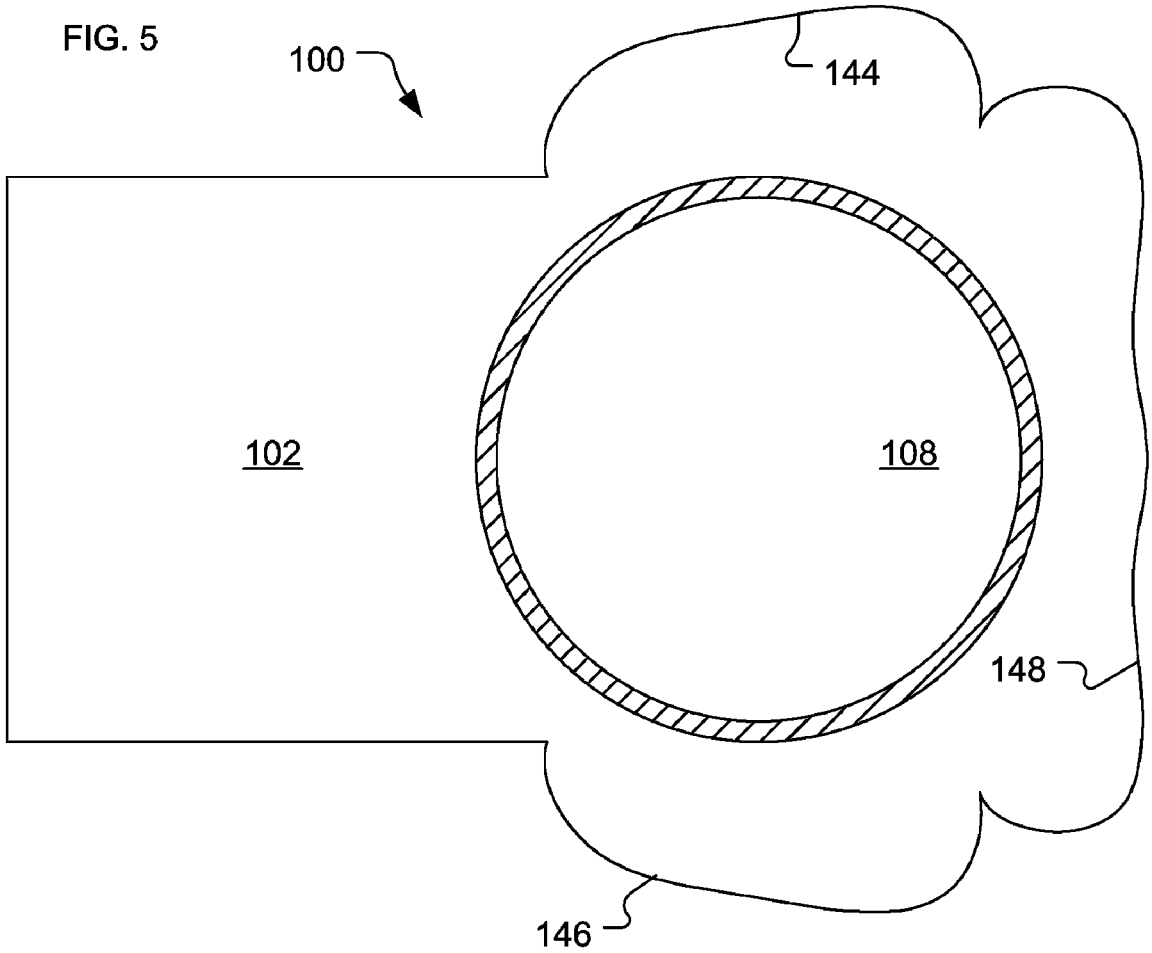
FIG. 5 is a top plan view of an alternate embodiment of a mode transducer in accord with the present invention, showing that the offset walls are not necessary completely planar and can have a more generalized form.

FIG. 5 is a top plan view of an alternate embodiment of a mode transducer 100, wherein it can be seen that the offset walls 144, 146, 148 are not necessary completely planar and can have a more generalized form.

Figure 6:
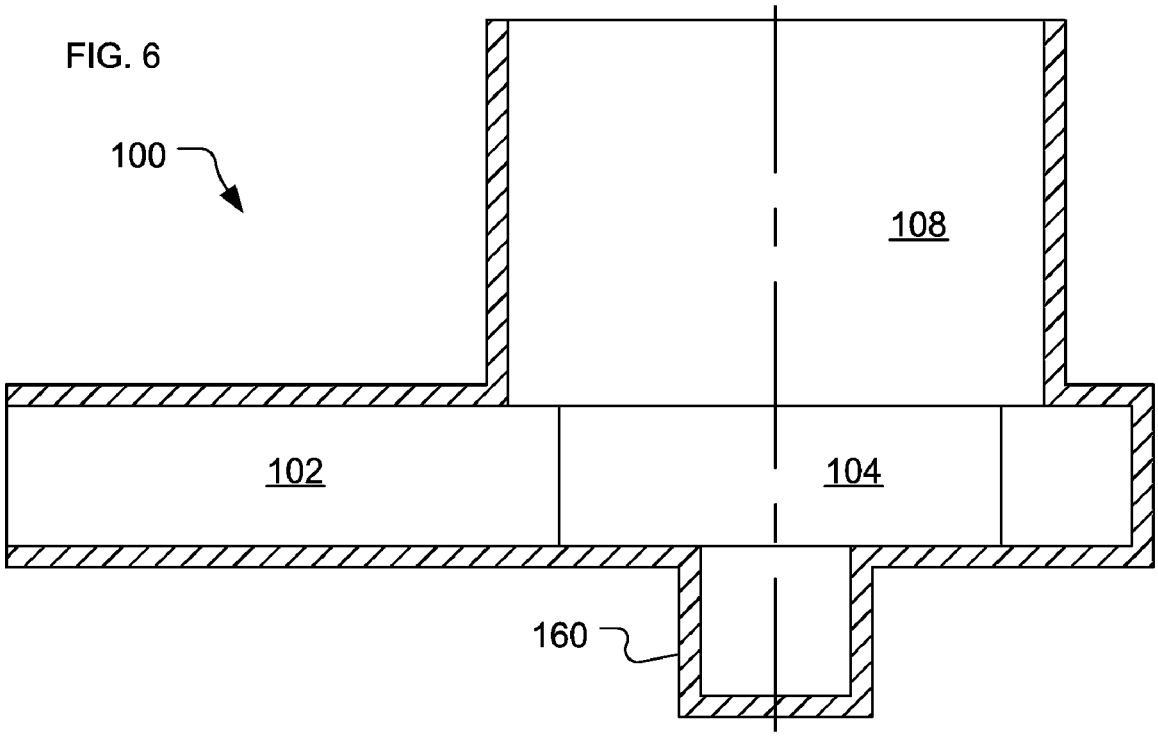
FIG. 6 is a side cross-section view of another alternate embodiment of a mode transducer in accord with the present invention, one having a suppressor stub added to improve performance.
Figure 7:
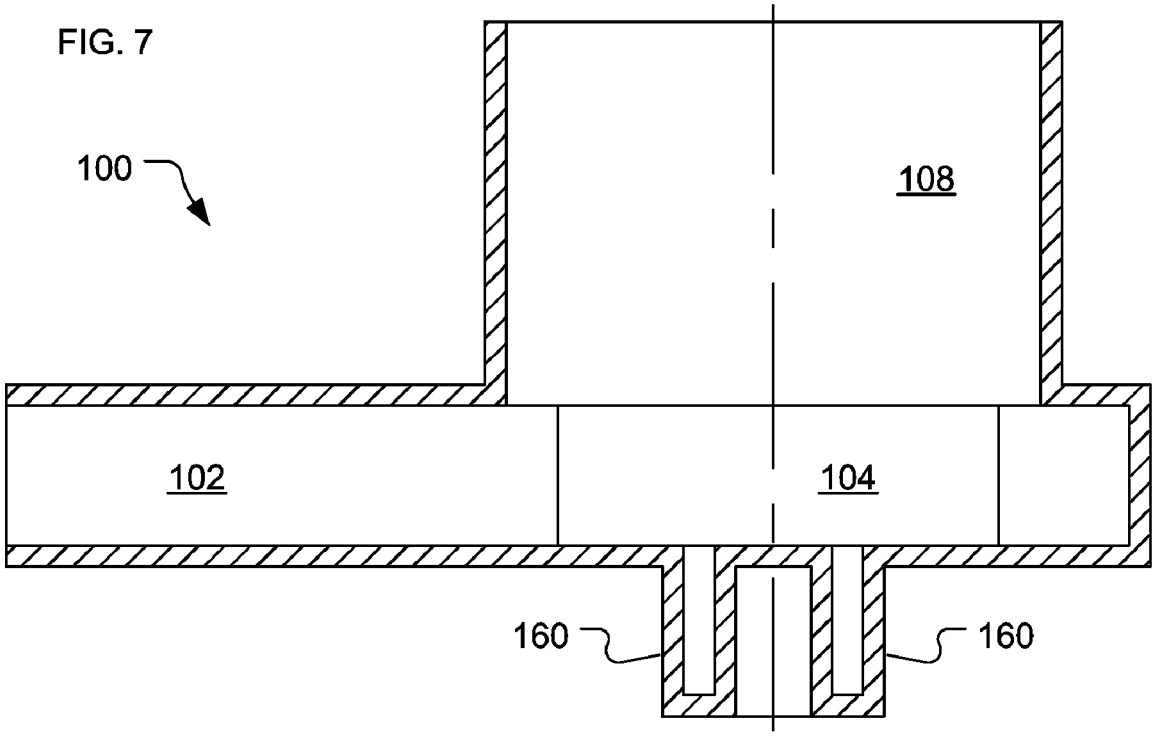
FIG. 7 is a side cross-section view of yet another alternate embodiment of a mode transducer in accord with the present invention, showing a more complex suppressor stub used.

FIG. 6 is a side cross-section view of another alternate embodiment of a mode transducer 100, showing that a suppressor stub 160 can be added to further improve performance of the mode transducer 100. FIG. 7 is a side cross-section view of yet another alternate embodiment of a mode transducer 100, showing that a more complex suppressor stub 160 can be used. In the waveguide arts it has long been known that suppressor stubs helps to suppress excitation into the undesired $TE_{1,1}$ mode. Embodiments of mode transducers in accord with the present invention may thus also, optionally, employ suppressor stubs in the traditional manner.

Figure 8:
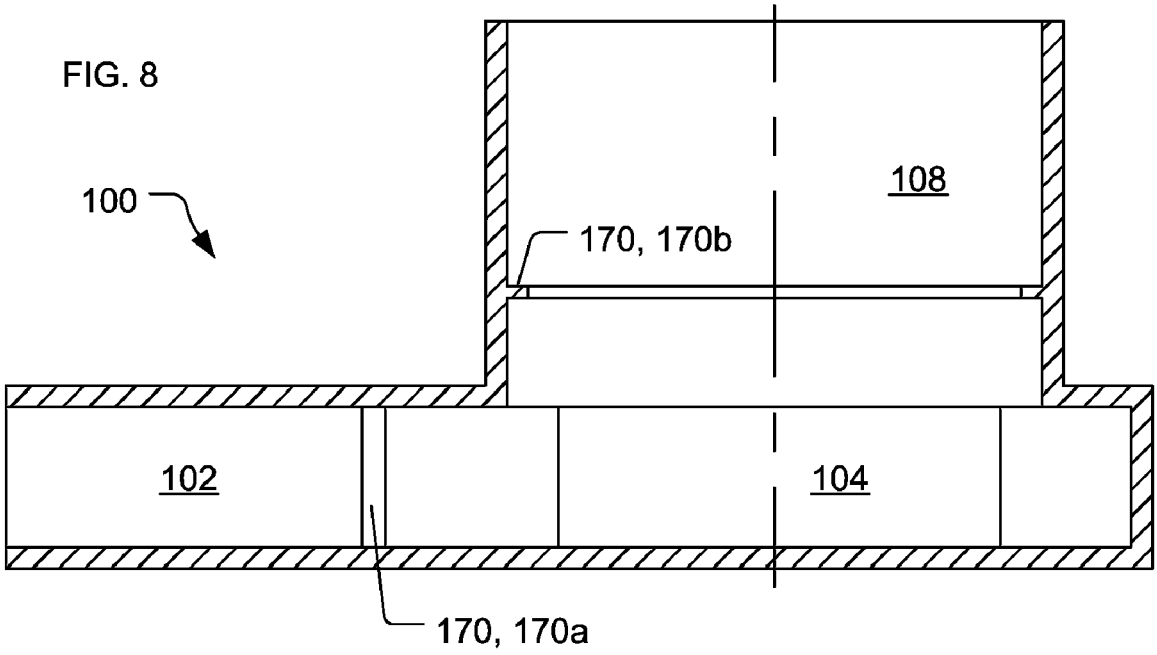
FIG. 8 is a side cross-section view of another still alternate embodiment of a mode transducer in accord with the present invention, showing the use of matching irises in the waveguide sections.

FIG. 8 is a side cross-section view of another still alternate embodiment of a mode transducer 100, here showing the use of matching irises 170 in the waveguide sections 102, 108. In the waveguide arts it has also long been known that such irises help to improve impedance matching, e.g., reduce VSWR over the required bandwidth. Embodiments of mode transducers in accord with the present invention may thus, optionally, also employ irises in the traditional manner. The iris 170*a* here in the rectangular waveguide section 102 is more generically termed a "baffle," since it reduces the cross-section only in one dimension (the Cartesian Z-axis here). Nonetheless, "iris" is widely used in waveguide literature. In contrast, the iris 170*b* in the circular waveguide section 108 is a true "iris" because it reduces the cross-section in two dimensions (the Cartesian X-and Z-axes here).

Figure 9:
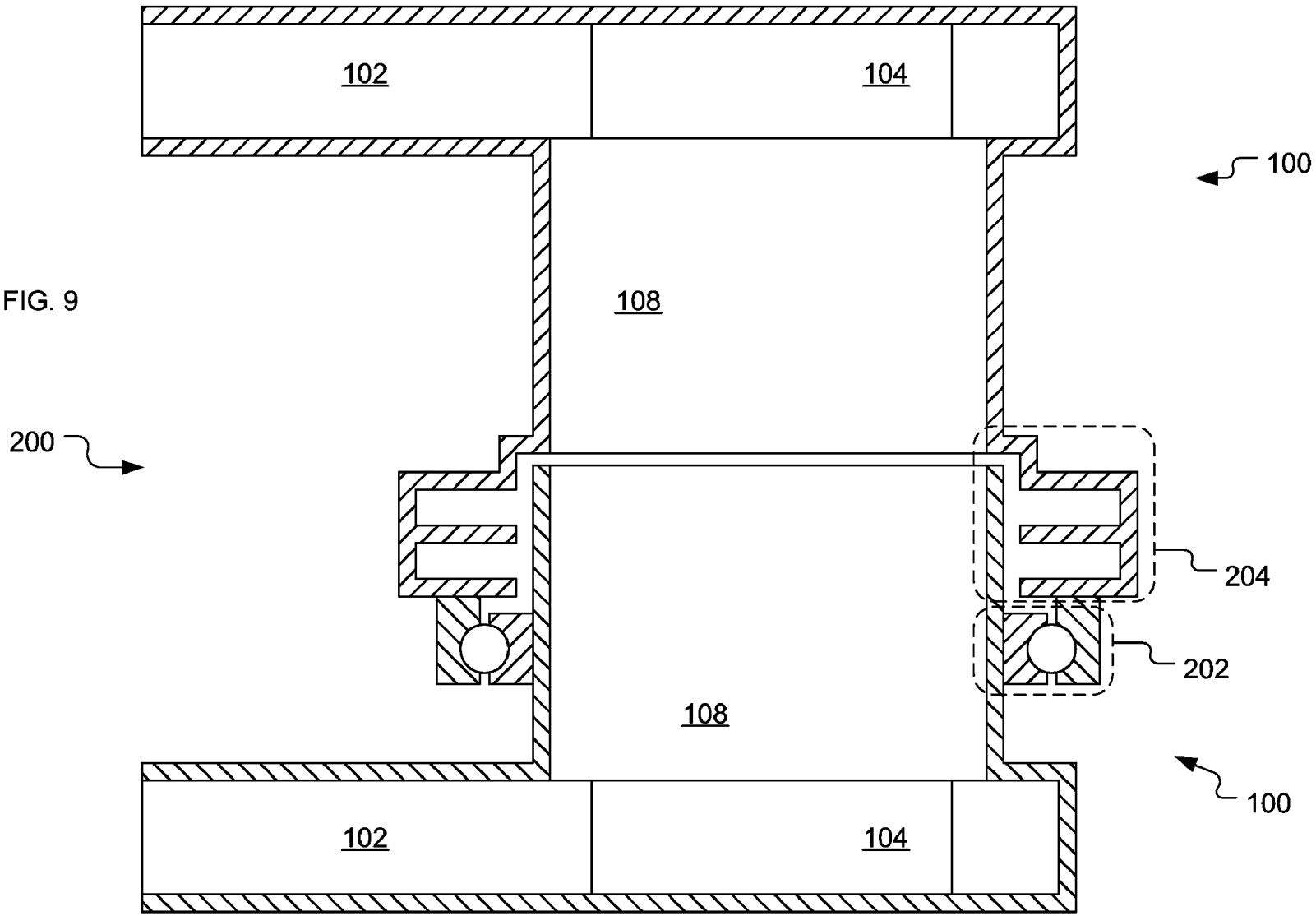
FIG. 9 is a side cross-section view of a rotary joint that can be constructed using two mode transducers, such as those in accord with the present invention.

FIG. 9 is a side cross-section view of a rotary joint 200 that can be constructed using two mode transducers 100. The two mode transducers 100 here resemble the embodiment in FIGS. 4*a*, 4*b*, but this is not a requirement and it is also not a requirement that the mode transducers used even be similar. For example, a rotary joint could be constructed using a conventional mode transducer and a mode transducer 100 in accord with the present invention. Suppressor stubs and irises could also be added to either or both to the mode transducers employed.

The rotary joint 200 in FIG. 9 includes a rotation mechanism 202 having a small-gap radio frequency choke 204 that provides an effective short-circuit so that electromagnetic energy is propagated efficiently between the circular waveguide sections 108. As is the situation with suppressor stubs and irises, however, the rotation mechanism is also generally an aspect of the conventional waveguide arts that can be extended in straightforward manner to structures in accord with the present invention, such as the exemplary rotary joint 200 here.

While various embodiments have been described above, it should be understood that they have been presented by way of example only, and that the breadth and scope of the invention should not be limited by any of the above described exemplary embodiments, but should instead be defined only in accordance with the following claims and their equivalents.

What is claimed is:

1. An apparatus for converting the mode of a guided electromagnetic wave from a first field configuration to a second field configuration, the apparatus comprising:

a rectangular waveguide section having a rectangular-section axis, a chamber section, and a circular waveguide section having a circular-section axis, wherein said rectangular waveguide section joins said chamber section at a rectangular-juncture and said circular waveguide section joins said chamber section at a circular-juncture such that said rectangular-section axis and said circular-section axis form a right angle;

said rectangular waveguide section having a first broadwall, a second broadwall, a first sidewall, and a second sidewall collectively defining a rectangular-end opposed to said rectangular-juncture;

said circular waveguide section having a circular wall defining a circular-end opposed to said circular-juncture;

said chamber section having an aperture-wall joining said first broadwall at said rectangular juncture, a base-wall joining said second broadwall at said rectangular-juncture, a first offset wall joining said first sidewall at said rectangular-juncture, a second offset wall joining said second sidewall at said rectangular-juncture, and a third offset wall opposed to said rectangular-juncture;

said aperture-wall including an aperture corresponding with said circular-juncture; and said first offset wall and said second offset wall of said chamber section being disposed more distally away from said rectangular-section axis than said first sidewall and said second sidewall, and said first offset wall, said second offset wall, and said third offset wall being disposed more distally from said circular-section axis than said circular wall.

2. The apparatus of claim 1, wherein said rectangular waveguide section, said chamber section, and said circular waveguide section are unitarily joined together.

3. The apparatus of claim 1, further comprising a suppressor stub extending from said base-wall and disposed more distally away from said rectangular-section axis than said base-wall.

4. The apparatus of claim 1, further comprising a matching iris in said rectangular waveguide section.

5. The apparatus of claim 1, further comprising a matching iris in said circular waveguide section.

6. The apparatus of claim 1, wherein the first field configuration of the guided electromagnetic wave is in $TE_{1,0}$ mode and the second field configuration of the guided electromagnetic wave is in $TM_{0,1}$ mode.

7. A rotary joint including two of the apparatuses of claim 1 defining first and second mode transducers, further comprising:

a rotation mechanism rotatably joining said circular-end of said first mode transducer and said circular-end of said second mode transducer to pass the electromagnetic wave in the second field configuration from said first mode transducer into said second mode transducer.

8. The apparatus of claim 7, wherein said rotation mechanism includes a small-gap radio frequency choke.

9. The apparatus of claim 7, wherein said circular-section axis of said first mode transducer and said circular-section axis of said second mode transducer are common.

10. The apparatus of claim 7, wherein said rectangular waveguide section, said chamber section, and said circular waveguide section of at least one of said first mode transducer and said second mode transducer are unitarily joined together.

11. The apparatus of claim 7, wherein at least one of said first mode transducer and said second mode transducer includes a suppressor stub.

12. The apparatus of claim 7, wherein at least one of said first mode transducer and said second mode transducer includes a matching iris in at least one respective said rectangular waveguide section.

13. The apparatus of claim 7, wherein at least one of said first mode transducer and said second mode transducer includes a matching iris in at least one respective said circular waveguide section.

14. The apparatus of claim 7, wherein the first field configuration of the electromagnetic wave is in $TE_{1,0}$ mode and the second field configuration of the electromagnetic wave is in $TM_{0,1}$ mode.

15. A transducer for converting an electromagnetic wave from $TE_{1,0}$ mode to $TM_{0,1}$ mode, comprising:

rectangular waveguide means for guiding the electromagnetic wave in $TE_{1,0}$ mode;

circular waveguide means for guiding the electromagnetic wave in $TM_{0,1}$ mode;

chamber means for converting the electromagnetic wave in $TE_{1,0}$ mode between and $TM_{0,1}$ mode, wherein said chamber means includes a first, a second, and a third offset walls distended away from proximal portions of said rectangular waveguide means; and said rectangular waveguide means joins said chamber means at a rectangular-juncture and said circular waveguide means joins said chamber means at a circular-juncture such that central axes through said rectangular waveguide means and said circular waveguide means form a right angle.

16. A rotary joint including two of the transducers of claim 15 defining first and second mode transducers, wherein said circular waveguide means of each said mode transducer has a respective circular end defined opposite the corresponding circular-juncture, and further comprising:

rotation means for rotatably joining said circular ends of said first and second mode transducers and for guiding the electromagnetic wave there between in $TM_{0,1}$ mode.

* * * * *